United States Patent [19]

Greiner

[11] Patent Number: 4,558,692

[45] Date of Patent: Dec. 17, 1985

[54] PASSIVE LEG EXERCISER

[76] Inventor: Donn B. Greiner, 506 Wellington Ave., Lincoln Park, Reading, Pa. 19609

[21] Appl. No.: 624,358

[22] Filed: Jun. 25, 1984

[51] Int. Cl.[4] ..... A61H 1/02

[52] U.S. Cl. ..... 128/25 R; 128/25 B

[58] Field of Search ..... 128/24 R, 25 R, 25 B, 128/71, 74, 75; 272/123, 129, 130; 269/322–325

[56] References Cited

PUBLICATIONS

Instruction Sheet User's Manual Miami Knee Motion Machine Kinetic Leg Exerciser.

*Primary Examiner*—Richard J. Apley
*Assistant Examiner*—J. Welsh
*Attorney, Agent, or Firm*—Ruth Moyerman

[57] ABSTRACT

A motor driven leg exerciser, for passive exercising of the knee, with foot and hand operated override controls is disclosed. The exerciser has an adjustable framework, an adjustable leg support, and a movable footrest which includes an override switch, a motor with housing, and controls for user and therapist. In operation, the motor drives a chain driven rod back and forth in an arc to move the leg support. As the rod reaches each end of its arc, it activates a directional switch which in turn stops the motor, causes the device to pause for a predetermined length of time, and reverses the direction of the rod. This series of motor stoppage, pause and reversal of direction are also activated by a pressure operated switch in the footrest, and by a hand held control.

14 Claims, 10 Drawing Figures

PASSIVE LEG EXERCISER

BACKGROUND OF THE INVENTION

1. Field of the Invention

This invention relates to kinesitherapy, and more particularly to a motor operated leg exercising machine.

2. Description of the Prior Art

Continuous passive motion applied to an injured or post operative leg is the primary rehabilitative treatment chosen by most doctors and therapists. Many leg exercising devices are known. Generally, these machines have a motor driven leg support, the leg support capable of being set to periodically move the leg in a desired range of positions at a desired length of extension and at a set speed. All these variables are preset by a physican or therapist. Once these angles and speed have been chosen, the machine automatically and continuously moves the leg from a straightened position back and forth into those prechosen positions.

If, because of stiffness, a patient's knee resists movement and does not move into the predetermined angle, either the machine will break, or the patient's knee may be damaged. Additionally, during a day's therapy, as the leg limbers and becomes capable of greater movement and flexibility, the machine must be reset to encourage greater movement. If the therapist is not present to reset the machine, there are often long periods of time when the most therapeutic degree of leg motion is not being achieved.

There is, therefore, a need for a passive leg exerciser which will stop when the resistance of leg to machine becomes too great, but which will still exercise the leg sufficiently.

Also, there is a need for a machine which will allow for increased flexibility of the treated leg and will "follow" the leg, not being limited to a preset range of motion.

SUMMARY OF THE DISCLOSURE

The aforementioned prior art problems are obviated by the device of this invention which is a motor driven leg exerciser with a motor override and time delay feature.

The device has a framework, a motor enclosed in a housing, a leg support, directional switches, hand operated controls and an adjustable, movable footrest which includes an override switch. The leg exerciser of this invention provides periodic movement of a leg in a cycle which includes the following steps: (1) the leg is extended to its full length; (2) the device pauses for a predetermined length of time; (3) the leg is then urged to a bent position; (4) the machine pauses again, preferably for the same amount of time as in step (2); (5) the leg is allowed to again assume its extended position.

In operation, the pause and reversal of direction are caused by any of three actions. First, a pressure operated foot pedal may activate the pause and reversal. The user places his leg on the leg support and the foot rest is moved to a position flat against the sole of his foot. A doctor or trained personnel predetermines and selects the length of the time delay feature and degree of pressure necessary to activate the override switch.

The machine, when operating, will start to bend the leg until pressure from the leg's failure to bend activates an override switch. An override switch is located in the footrest and is operated by pressure of the foot on the footrest. The machine then pauses for the preselected time and then retracts, allowing the leg to resume its extended position. Time delay is again activated in the extended position. At the end of this second delay, the leg is then automatically urged back into its bent position. Because the full extent of the bending is controlled by the patient's foot pressure and not by a preset device, the leg, as it loosens up during exercise, may assume more critical positions without the machine being reset. In other words, the machine "follows" the leg—it does not force it.

The second method to activate the stoppage, pause and reversal is by the user pressing an override switch in a hand held control box. This method is used when a patient wishes to temporarily stop therapy as well as when he feels pain and desires to reverse leg movement.

The third method of stoppage, pause and reversal is by the use of directional limit switches. The leg support is driven by a rod connected to the parallel sides of the leg support. As that rod reaches the full extent of its range of movement, it activates directional limit switches located inside the motor housing. These switches stop the motor and reverse the direction of movement after a pause. This method is employed when the user's leg permits the machine to reach its full range of movement—as when the leg is almost healed.

The device also has switches for the user to turn it on and off completely. It also includes exterior switch, controls for regulating the amount of pressure required to activate the override switch, and controls to set the length of time delay. The footrest is movable and may be moved along the leg support until it is at a length appropriate to the length of the user's leg.

It is, therefore, an object of this invention to provide a device for passively exercising an injured or post operative leg which will operate continuously without causing pain to the user.

It is another object of this invention to provide a device which will pause when pressure upon the leg is greatest and reverse itself to release that pressure.

It is yet another object of this invention to provide a device which is adjustable to leg length.

It is still another object of this invention to provide a device which will have a foot operated override switch.

It is another object of this invention to provide a device which will include a hand operated override switch.

It is a further object of this invention to provide a device which supports the entire leg during exercising.

It is yet a further object of this invention to provide a device in which the motor and operating parts are safely housed beneath the leg support.

It is another object of this invention to provide a device which prevents stiffness in a post-operative leg.

It is yet a further object of this invention to provide a device which decreases the likelihood of phlebitis occuring because of increased circulation to the limb during recuperation.

It is yet another object of this invention to provide a device useful in the treatment of quadriceps, extension of knee, and hip movement and decrease total recovery time.

It is still a further object of this invention to provide a device which offers a time delay to give tissues time to stretch and accommodate themselves to many positions.

These and other objects will be more readily ascertainable to one skilled in the art from a consideration of the following Figures, drawing and exemplary embodiments.

BRIEF DESCRIPTION OF THE DRAWING(S)

Figure 4:
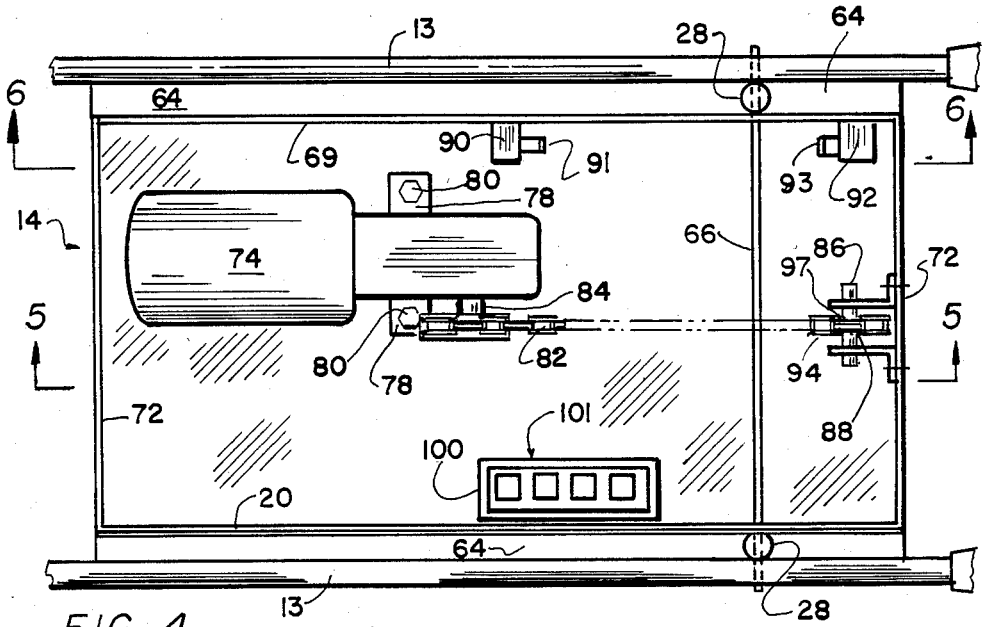
FIG. 4 is a top section taken through the motor housing of this invention.
Figure 5:
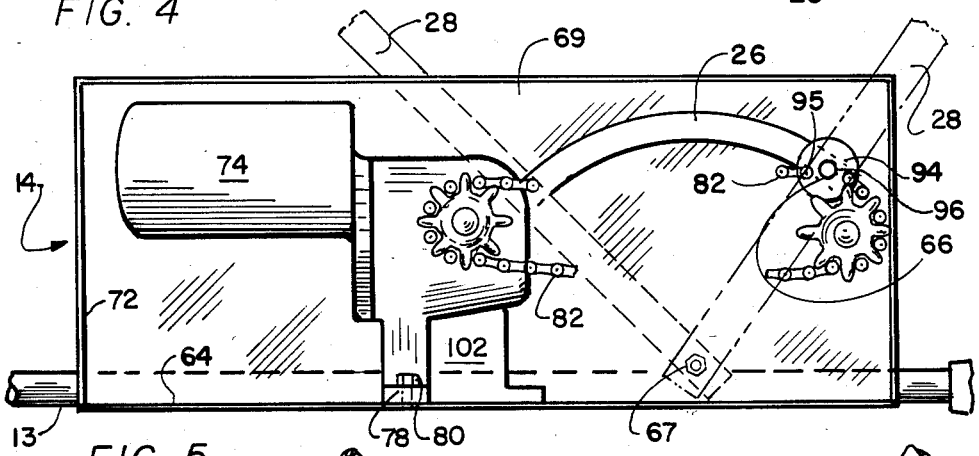

FIG. 5, taken on lines 5—5 of FIG. 4, depicts the chain drive rod and the time delay switch of this invention.

Figure 6:
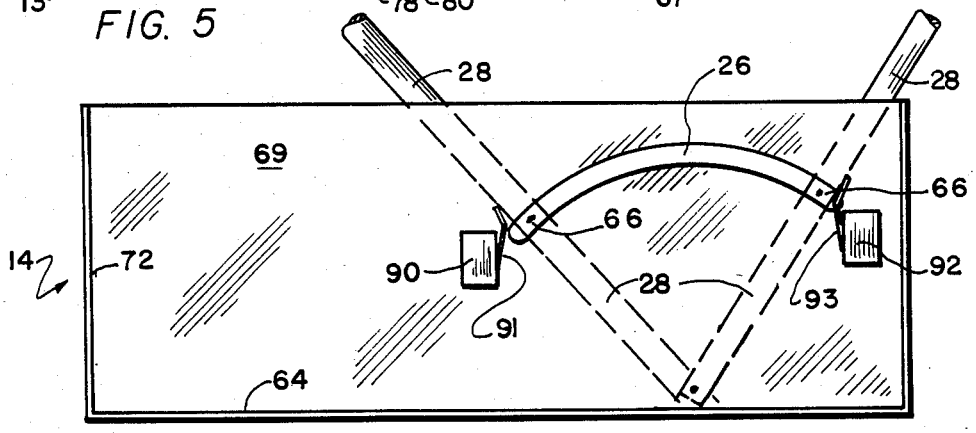

FIG. 6, taken on lines 6—6 of FIG. 4, shows the directional switches of this invention.

Figure 7:
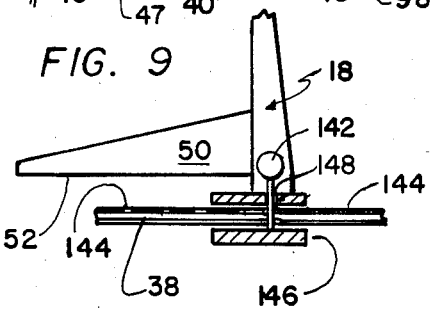

FIG. 7 shows, in more detail, an enlarged side view of the movable attachment of the footrest to the leg support of this invention.

Figure 8:
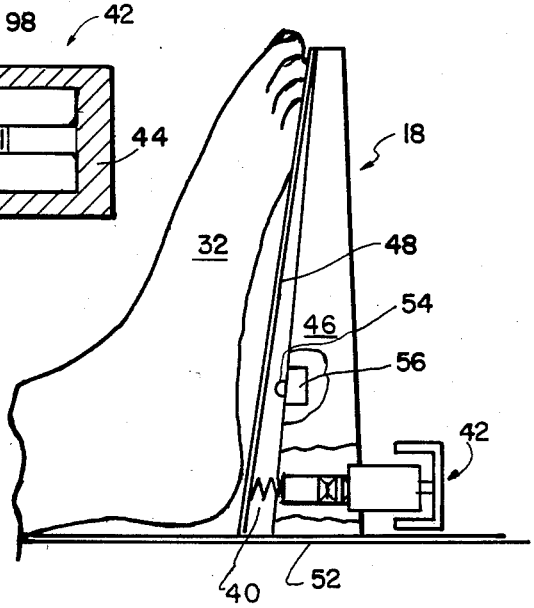

FIG. 8 shows a side view of an enlargement and detail of the footrest of this invention.

Figure 9:
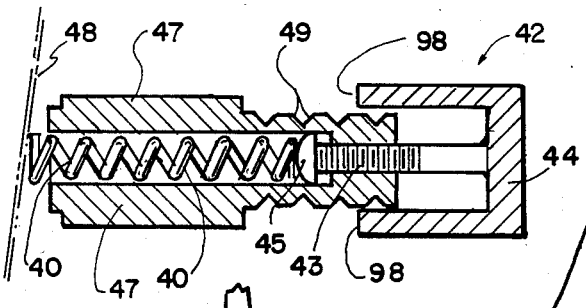

FIG. 9 is an enlargement of the spring adjuster shown in FIG. 8.

Figure 10:
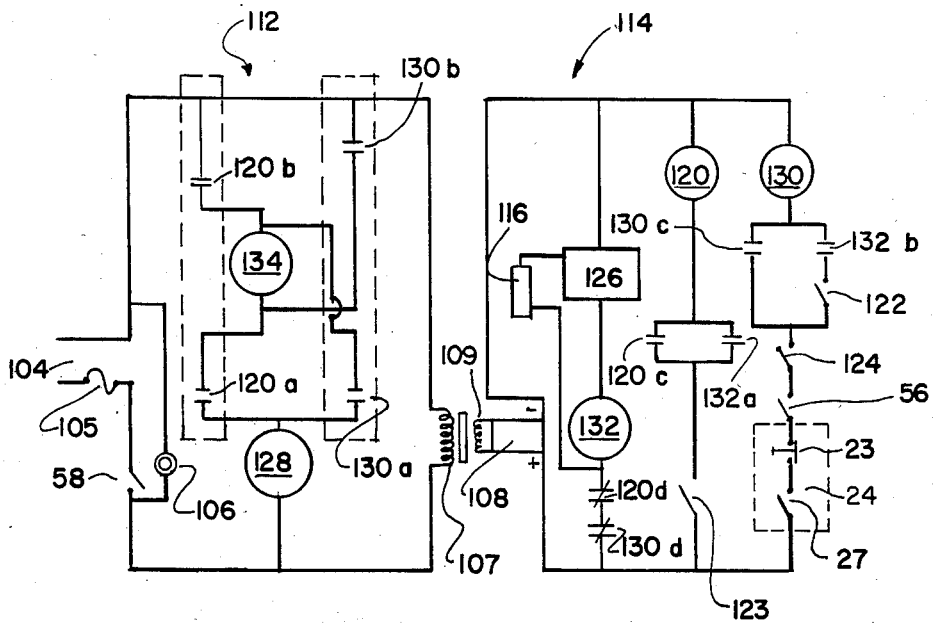

FIG. 10 is a schematic drawing of the wiring diagram of this invention.

DETAILED DESCRIPTION OF THE PREFERRED EMBODIMENT(S)

Figure 1:
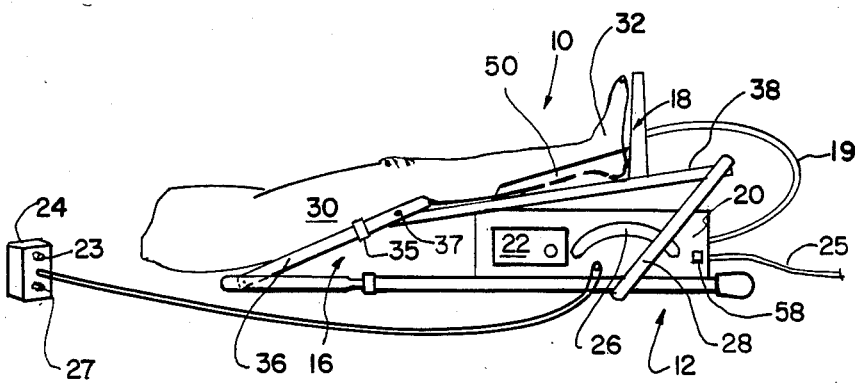
FIG. 1 is a side view of the leg exerciser of this invention in use, the leg extended.
Figure 2:
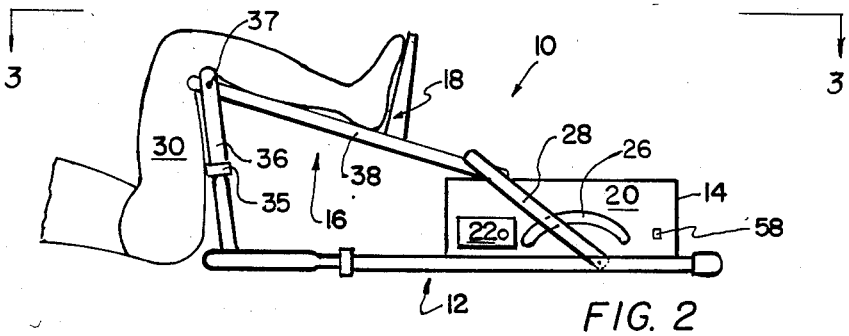
FIG. 2 is a side view of the leg exerciser of this invention, without cables, the leg in a bent position.

Now referring to the Drawings, and more particularly to FIGS. 1 and 2, a side view of leg exerciser 10 of this invention is shown. Leg exerciser 10 includes motor housing 14, framework base 12, limb support 16 and footrest 18. On the outside of wall 20 of motor housing 14 are seen control panel 22, on/off switch 58, and arc-shaped slot 26 which allows movement of arm 28. Also seen are cable 19 leading from footrest 18 to motor housing 14, main cable 25, and patient control box 24.

In FIG. 1, arm 28 is seen at one end of arc-shaped slot 26. When arm 28 is in the position shown in FIG. 1, it has pulled limb support 16 to its longest extension. In this position, patient's leg is extended to its fullest length. When patient's leg 30 is in the extended position, the time delay will be in effect, relaxing leg 30 for a predetermined length of time. The time delay feature will be more fully explained with reference to FIG. 10.

In FIG. 2, leg 30 has been bent to its most acute angle by the movement of limb support 16. Arm 28 has reached the opposite end of arc slot 26 from the view shown in FIG. 1 and has forced limb support 16 into its angular position. Again, leg 30 will remain in this position for a predetermined length of time. Limb support 16 is capable of assuming an angular configuration because it is formed of telescoping rods 36, which are capable of a vertical position, and longitudinal rods 38 joined to rods 36 by pins 37. There is a set of rods 36 and 38 on each side of leg 30. Rod 36 is adjustable to allow for differing thigh lengths of different users. In this preferred embodiment, the adjustability is provided by forming rod 36 of two telescoping sections, fastened by bolt 35.

It can be seen in both FIGS. 1 and 2 that leg 30 is fully supported in both positions by limb support 16, more particularly by calf support 50 (hidden from view in FIG. 2) and thigh support rods 26. Additionally, in use, a soft cover (not shown) may be stretched over limb support 16 and holds leg 30 between the paired support rods 36 and 38. The pairing of rods 36 and 38 is better seen in reference to FIG. 3.

The patient need use none of his own leg muscles to move his leg into these positions. Leg exerciser 10 moves his leg for him in a constant, passive manner. This factor is important since a person in recovery from injury or operation will not have the strength to do this kind of exercise. The constant passive exercise of leg exerciser 10 is the preferred method of treatment for hip, knee and leg.

Also seen in FIGS. 1 and 2 are patient control box 24 and control panel 22. A doctor or therapist will preselect and set controls on panel 22 according to the patient's needs. Panel 22 holds controls for setting the duration of the time delay. Patient control box 24 contains switches 23 and 27 to allow the patient to temporarily stop the motion of leg exerciser 10, reverse direction, and then to start it again (switch 23), or to completely turn off the machine (switch 27). These features are necessary for the patient's safety and comfort. These features will be more completely explained in reference to FIG. 10.

Also seen in FIGS. 1 and 2 is footrest 18. Footrest 18 is an important part of this invention. When leg 30 is in the position shown in FIG. 2, foot 32 is pressed against footrest 18. When leg 30 resists the movement of leg exerciser 10, pressure will be forced against footrest 18 and override switch 56 (seen in FIG. 8) will be put in operation. The override feature and time delay will be more fully explained with reference to FIGS. 8, 9 and 10.

Figure 3:
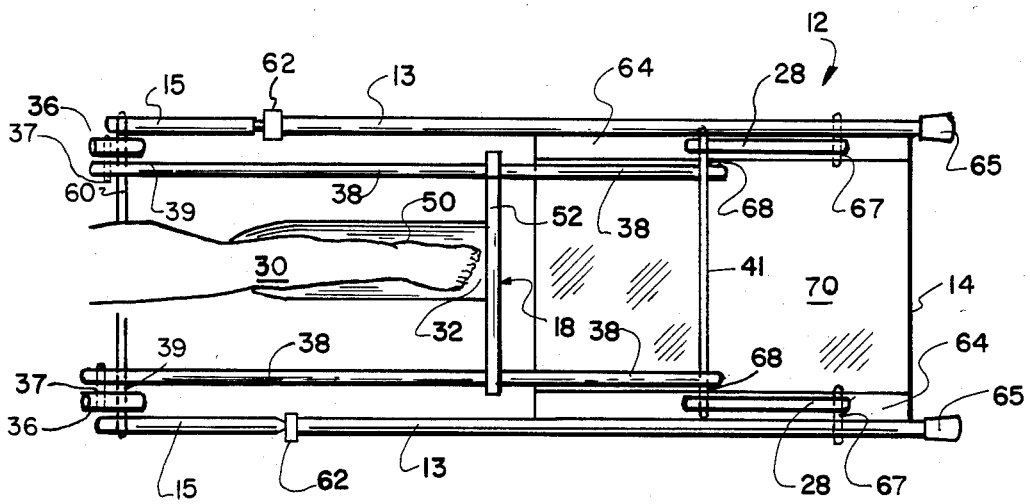
FIG. 3 is a top view of the device of this invention with a leg in position taken along lines 3—3 of FIG. 2.

Now referring to FIG. 3, a top plan view of the invention is shown. Leg 30 is seen supported on calf support 50. Leg support rods 38 are seen, one on each side of leg 30. Thigh support rods 36 are seen in the near vertical position. Pins 37 are seen joining rods 36 and 38. In use, a soft cover (not shown) is stretched over thigh support rods 36 and 38, calf support 50 and footrest 18 to provide nonabrasive support to leg 30.

Thigh support rods 36 are pivotably joined to rods 38 by pins 37. Rods 36 are joined to each other and to framework 13 by rod 39, covered by leg spacer sleeve 60. Leg support rods 38 are joined to each other by transverse rod 41 and to arms 28 by pins 68. Also, arms 28 are attached to framework rod 13 by pins 67. Pins 67 extend through framework rod 13, through arm 28, and into housing 14 to allow arm 28 to pivot. Thus, as arm 28 moves in an arc as seen in FIG. 1 and 2, it forces limb support 16 to move, possible because rods 36 and 28 are able to pivot on transverse rod 39 and rods 13 respectively while rods 36 and 38 pivot on pins 37.

Also seen in FIG. 3 are elements of framework 12. Framework 12 also uses transverse rod 39 as a connection for longitudinal rods 15. Base 12 is adjustable in length. This adjustment is necessary to prevent rods 36 and 38 from assuming a V shape (as distinguished from the inverted V shown in FIGS. 1 and 2. Adjustment is possible because rods 13 and 15 are preferably telescoping. Once a length has been chosen for rod 15, fastening bolt 62 is tightened to secure rod 15 in place. Rods 13 are joined at their opposing ends by floor plate 64 of housing 14. Seen on ends of rods 13 are caps 65. Plate 64 serves also as floor for motor housing 14 which has ceiling 70.

Also seen in FIG. 3 is base 52 of footrest 18. Footrest 18 is better seen in FIGS. 7 and 8. Base 52, preferably a flat bar, is attached at each of its ends to a rod 38. Base 52 is also attached to calf support 50 as that calf support 50 moves as one with footrest 18. It can be seen in FIG. 3 that leg 30 is aligned parallel to limb support rods 36 and 38 of limb support 16 with foot 32 touching footrest 18. In this aligned position, leg 30 is exercised correctly. With soft covers (not pictured) stretched across the framework of limb support 16, leg 30 naturally and comfortably assumes the correct position on limb support 16.

Referring now to FIG. 4, the inside of motor housing 14 is visible because ceiling 70 is removed. Motor housing 14 has side walls 20 and 69 and end walls 72. Plate 64 serves as a floor for motor housing 14 and is attached to longitudinal rods 13 of framework 12.

Indicated in FIG. 4 is motor 74 having an output shaft 84. Motor 74 is fastened to floor plate 64 by legs 78, attached by bolts 80. It is seen that motor 74 is operably connected to one end of chain 82 by shaft 84. At chain 82's other end is pin 86 running through idler sprocket 88. Channel 97 holds sprocket 88 in place, defining an end of chain 82's extension. Running through chain 82 is connecting rod 66 which moves arms 28.

The operation of chain 82 is better seen in FIG. 5.

Also seen in FIG. 4 are directional switch boxes 90 and 92. Switch boxes 90 and 92 have spring loaded plates 91 and 93. When plates 91 and 93 are pressed, springs inside them compress, allowing plates 91 and 93 to activate, respectively, switches 123 and 122 (not seen) located inside boxes 90 and 92. When spring loaded plate 90 is pressed by connecting rod 66 (as it would be when leg 30 is in the position illustrated in FIG. 2), switch 123 located inside box 90 (shown in FIG. 10) reverses the direction of connecting rod 66 and the attached arms 28. Likewise, when connecting rod 66 presses on plate 93, as it would when leg 30 is in the position shown in FIG. 1, switch 122 inside box 92 (seen in FIG. 10) again reverses the direction of motion of rod 66.

The operation of connecting rod 66 with switch boxes 90 and 92 is better seen in FIG. 6.

Also seen in FIG. 4 is top hat-shaped box 100 holding relays 101. All electrical controls are explained in reference to FIG. 10.

Now referring to FIG. 5, the operation of chain 82 and arms 28 is shown. Motor housing 14 is shown containing motor 74 and chain 82. Motor housing 14 has end walls 72 and side wall 69. Motor housing 14 is seen attached to rod 13 through its floor plate 64. Motor 74 is attached to floor 64 by leg 78 and bolt 80, and by brace 102.

In operation, chain 82 pulls connecting rod 66 through an arc defined by the length of chain 82. Connecting rod 66 is permanently attached to chain 82 by connector plate 94. Links 95 and 96 of chain 82 are also permanently fastened to connector plate 94. Connector rod 66 extends through plate 94. Thus, as chain 82 is moved, so is connector rod 66 and through it arms 28 move leg support 16 (seen in FIGS. 1 and 2).

Also seen in FIG. 5 is slot 26 (in wall 69) which allows connector rod 66 to move through its chain-defined arc. Arm 28 (shown in phantom) is shown at its limit points in slot 26. At those points, connecting rod 66 would activate switches 91 and 93 as seen in FIGS. 4 and 6 to reverse direction of chain 82.

Also seen in FIG. 5 is pin 67 which attaches arm 28 to framework rod 13. Arm 28 rotates around pin 67, allowing arm to move while simultaneously firmly attaching it to framework 12.

Now referring to FIG. 6, connector rod 66 is shown pressing against spring plates 91 and 93 of switch boxes 90 and 92. As in FIGS. 4 and 5, motor housing 14 is shown having floor 64, end walls 72 and side wall 69. Side wall 69 includes slot 26 to allow for movement of connecting rod 66. Arm 28 (shown partially in phantom) is seen at its limits in slot 26.

In the positions shown, connecting rod 66 would activate switches 123 and 122 inside boxes 90 and 92 respectively by pressing on plates 91 and 93 to reverse the direction of chain 92 (seen in FIG. 5) and thus reverse the direction of limb support 16 (seen in FIGS. 1 and 2).

Thus, in FIGS. 4, 5 and 6 it is shown how leg exerciser 10 operates. In operation, chain 82, powered by motor 74, moves connecting rod 66 towards the user. When rod 66 presses switchplate 91, motor 74 will stop, pause and then reverse the direction of movement of chain 82. Chain 82 then moves rod 66 away from the user until it presses plate 93 where the motor will again stop, pause and reverse direction of movement of chain 82 to set up a periodic back and forth motion. The pause at both ends is provided by preset time delay switches which are activated simultaneously with directional switches in boses 90 and 92 as will be further explained with reference to FIG. 10.

A feature of this invention is that at each reversal of motion, a time delay is put into effect, thereby resting the leg. Also, if a user's leg resists motion toward switchplate 91, an override switch is provided. These override and time delay features are explained in relation to FIGS. 8, 9 and 10.

Now referring to FIG. 7, attachment of footrest 18 to limb support 16 is shown. Identical attachment is made on each end of footrest 18 to each of rods 38; only one such attachment will be described.

Footrest 18, attached to base 52 with calf support 50, has pin 142. Pin 142 extends through footrest 18's bottom and into and through base 52 near base 52's end. Rod 38, which has spaced apertures 144, is fitted with cover pipe 146. Cover pipe 146 has an aperture 148 to accept pin 142. In operation, matching apertures in rods 38 will be chosen, according to length of user's legs, for placement of footrest 18. Pins 142 will be inserted into matching apertures 144 and footrest 18 will be held firmly in place on leg support 16. Pipe cover 146 prevents footrest 18 from shifting on rod 38.

Now referring to FIG. 8, user's foot 32 is seen in place on footrest 18. Footrest 18 is seen including housing 46, pedal 48, spring 40 and spring adjuster 42. The operation of spring adjuster 42 is more fully explained with reference to FIG. 9.

Footrest 18 is linked by base 52 to longitudinal rods 38 and calf support 50 as shown in FIGS. 3 & 7. In use, spring adjuster 42 is preset to regulate the amount of pressure necessary to move pedal 48 towards housing 46. Pedal 48 is pivotally attached to housing 46. When sufficient pressure is exerted, foot 32 will push pedal 48 to press button 54 on housing 46. Button 54 activates override switch 56 located inside housing 46 and shown in cutaway.

When override switch 56 is activated by button 54, it will stop the motion of leg support 16, without operation of switchbox 90 as explained in reference to FIGS. 4, 5 and 6. The machine will then pause for a predetermined length of time (to be discussed in reference to FIG. 10) and then the direction of limb support 16 will reverse. Because pressure from foot 32 can stop leg movement, injury is prevented—to user as well as machine. Resistance from user's leg 30 determines movement of limb support 16, not a preset machine selection. Thus, this leg exerciser is infinitely adjustable to the capabilities of each individual leg. Also, the phase instituted by override switch 56 allows the leg muscles to stretch and accommodate to each new position.

Now referring to FIG. 9, an enlargement of adjuster 42 in cross section is shown. Adjuster 42 is shown including spring 40, adjustable bolt 43, handle 44 and bolt head 45. Bolt 43 is threaded through guide 47 which extends inside housing 46. Exterior guide 47 is marked at predetemined intervals by indentations 49. Handle 44 is C-shaped.

In use, ends 98 of handle 44 are aligned with a set of predetermined indentations 49. As handle 44 is turned toward housing 46 to achieve alignments with indentations 49, spring 40 is compressed by pressure of bolt head 45. As spring 40 is compressed, it becomes necessary to exert greater force on pedal 48 to push button 54 (seen in FIG. 8). Thus, at the beginning of therapy, a setting near the outer end of guide 47 is chosen (as seen in FIG. 9), allowing a user to exert slight pressure of pedal 48 to activate override switch 56. As a user's leg becomes more limber, he is capable of exerting greater pressure without overworking his leg or the machine. and handle 44 is set closer to housing 46 (as seen in FIG. 8) to require more pressure against compressed spring 40.

Now referring to FIG. 10, a diagram of the wiring of this invention is shown. In operation, 120 v AC current of electricity enters the machine at point 104, passing through fuse 105 to main switch 58 located on control panel 22 (seen in FIG. 1). When switch 58 is closed, pilot light 106 will be lit. Current then flows through transformer winding 107, inducing flow in secondary winding 109 as part of a filtered power supply 108 which converts voltage to 12 v DC. Thus we see that there are two main areas of interest in wiring diagram 10. Area 112 shows the motor and its switches. Power in this area is 120 v AC. Area 114 is the control area and power in that area is 12 v DC. Patient control box 24 is seen containing switches 23 and 27.

There are three relays seen in FIG. 10. Motor relay 120 controls switches **120*a*, 120*b*, 120*c* and 120*d*. Motor relay 130 controls switches 130*a*, 130*b*, 130*c* and 130*d*. Timer relay 132 controls switches 132*a* and 132*b***.

With the leg in extended position and switches 58 and 27 closed, the following steps will occur. 12 v DC current will flow from filtered power supply 108, through switches **130*d* and 120*d* (both normally closed), to potentiometer 116 which controls timer 126. Timer 126 will start the time delay period. At the end of time delay, time relay 132 will come on. The duration of the time delay is controlled by the setting of potentiometer 116. In the preferred embodiment, timer 126** is a standard LC-555 general purpose timer as described in *LC Timer Cookbook* by Walter G. Jung on pages 19–35.

When the machine is in the extended position, limit switch 122, normally open, is closed mechanically by pressure of connecting rod 66 against switch 122 in box 92 (as seen in FIGS. 4 and 6). Current flows from the power supply 108, through patient remote switch 27 which is closed, patient hand override switch 23, (normally closed), and foot operated switch 56 (normally closed). Limit switch 124 is also normally closed and power reaches limit switch 122 (mechanically closed). Current reaches motor relay 130 through time relay switch **132*b* which has been closed by time relay 132. Switch 130*c* is then activated to keep relay 130** energized until one of the normally closed switches is opened.

Controls in section 114 will now start. Controls active in section 114 will start motor 74. With the leg extended, the current will follow this path: armature coil 128 to motor relay switch **130*a* (normally open, now closed); relay switch 130*a* to field coil 134; field coil 134 to motor relay switch 130*b* (normally open, now closed). At this stage motor relays 120*a* and 120*b* are open. Additionally, when motor relay 130 became active, timer 126 reset as a result of motor relay 130*d*** (normally closed) being opened.

Motor 74 will run until one closed switches 27, 23, 56 or 124 opens, causing loss of current to motor relay 130. In normal operation, that motor stoppage will occur next with the leg in a bent position.

When the leg is in the bent position, limit switch 123 is closed (as normal) and limit switch 122 is open (as normal).

The timing process explained previously repeats itself.

Since limit switch 122 is open, the only flow of current possible is to motor relay 120 as follows: through limit switch 123 (normally closed) to time relay switch **132*a* (closed by time relay 132 in timing process) to motor relay 120. Motor relay 120 is now held on by motor relay 120*c* through limit switch 123. Motor 74 now reverses direction because the flow of current through field coil 134 is reversed as follows: current flows from armature coil 128 to motor relay switch 120*a* (normally open, now closed by motor relay 129). Current then passes to field coil 134. Motor relay switch 120*b*** (normally open, now closed) now completes the circuit.

Motor 74 will now run in the reversed direction until motor relay 120 is de-activated when limit switch 123 (normally closed) is opened mechanically.

This process of reversing motor direction and time pauses will continue until main switch 58 or patient switch 27 is placed in the off position.

In FIG. 10 it is also seen how patient override 23 and foot pedal override switch 56 are capable of cutting current to control section 114 and thus stopping the machine as it moves toward the bent position.

As has been seen in reference to FIGS. 8, 9 and 10, the override feature of this invention offers an adjustability and a degree of safety heretofore unavailable. Leg exerciser 10 exercises a leg in back and forth motion. As a user's leg 30 reaches its furthest extended position, leg exerciser 10 stops and pauses, allowing leg 30 to rest in its most beneficial position. Additionally, if leg exerciser 10 moves leg 30 into a position causing too much pressure on leg 30, override switch 56 or hand control switch 23 will automatically stop motor 74 to prevent injury to user or machine.

There are many variations possible within the scope of this invention. A potentiometer is shown to produce time delay. Any timing device would be suitable. Additionally, in the preferred embodiment, time delay could range from five to sixty seconds. Timing may be varied considerably and still be within the scope of this invention.

Footrest 18 is shown attached by pins 142. Any means which will provide adjustability and firm attachment is within the scope of this invention.

Rods 36 of limb support 16 and rods 13 and 15 in framework 12 are shown as telescoping. Any method of providing lengthwise adjustment to limb support 16 and framework 12 are within the scope of this invention.

Framework 12 and limb support 16 are shown composed of rods. Bars or other strong sectional pieces may be used and still be within the scope of this invention.

Switches shown in this invention may be spring loaded, toggle, or push botton and still be within the scope of this invention.

The time delay is controlled by a general purpose LC-555 model timer. Any general purpose timer would be suitable and still be within the scope of this invention.

There are many advantages to the device of this invention. Chiefly, this leg exerciser prevents injury to a user's knee or to the machine by providing a pressure operated override switch which will stop the machine's action before injury can occur.

It also provides an override switch to be operated by the user in a hand-held control box, thereby allowing the user to stop the machine if leg movement becomes painful.

It also allows the machine to move the leg to an increasingly acute angle as the leg limbers and offers less resistance and less pressure on the foot operated override switch. Thus, the machine "follows" the leg rather than forcing it.

This machine decreases the length of hospital stay by providing early pain-free motion to the leg during the hospital stay.

Because this leg exerciser offers constant, passive range of motion with very little effort or pain to the patient, the total period of recovery is decreased.

The time delay switch gives tissues time to stretch and accommodate to many positions, a feature not present in other leg exercisers.

By elevating the leg and by constant movement, circulation is improved and, thus, this machine aids in the prevention of phlebitis.

This machine is useful for the treatment of several conditions — intra-articular knee fracture, reconstructed knee ligaments, total knee joint replacement, and others.

Having now illustrated and described my invention, it is not my intention that such description limit the invention, but that the description be limited only by a reasonable interpretation of the appended claims.

What is claimed is:

1. In a motorized leg exerciser, said exerciser including an adjustable framework of rods, a movable jointed rectangular limb support operably connected to said rod's framework and a motor including a housing to activate periodic movement of said limb support, the improvement comprising:

(a) a footrest movably attached to said limb support so as to adjust to the user's leg length, said footrest including a foot pedal operably connected to an override switch;

(b) electrical override means operated by said override switch to stop said motor and reverse the direction of movement of said limb support;

(c) electrical means to stop said motor and reverse the direction of movement of said limb support, (d) preferential electrical timing means to cause a pause of a predetermined length each time said override means or said electrical means is activated; and, whereby, when a user places a leg on said limb support with the sole of his foot flat against said footrest, said exerciser will periodically, through said jointed limb support, move and thereby bend said user's leg a predetermined angular distance, said distance being determined by resistance pressure of the leg to bend, so that when said resistance pressure is exceeded, the user's foot presses said foot pedal against said override switch, activating said override switch, thereby stopping said motor through said preferential timing means for a timed pause and thereafter putting said motor in reverse to prevent leg injury or damage to the exerciser.

2. The leg exerciser according to claim 1 including, additionally, a hand operated switch to activate said override means.

3. The leg exerciser according to claim 1 wherein to achieve said adjustability of said footrest rectangular limb support's said longitudinal sides include spaced apertures and said footrest includes an enlongated base, and wherein pins are provided in each of said base's ends, said pins providing attachment means of said base to said apertures.

4. The leg exerciser according to claim 3 wherein said foot pedal of said footrest is a plate and wherein said plate is pivotally attached at its upper end to the upper end of a housing containing said override means, and wherein said exerciser includes additionally a spring generally within said housing at said housing's base and extending therefrom to said plate's lower end to provide adjustable foot pressure, whereby, when said spring is compressed by said plate located on said housing, said plate activates said override switch.

5. The leg exerciser according to claim 4 wherein said footrest's housing comprises front and back walls, top and bottom ends and vertical sides, said spring's one end extending through said housing's front wall toward said plate and said spring's other end terminating inside said housing and an adjustable, calibrated, threaded bolt ending at one end in a handle, said bolt located in said housing with said handle's gripping end exterior said housing's back wall, said bolt's other end engaging said springs's inner end so that the turning of said bolt adjusts the tension of said spring, thereby controlling the degree of pressure needed to compress said spring.

6. The leg exerciser according to claim 1 wherein said electrical motor is a gear reducing motor which is connected to a chain drive, said chain drive operating said leg support.

7. The leg exerciser according to claim 6 wherein said chain drive operation of said limb support includes:

(a) two arms, one each connected to each of said movable leg support's longitudinal sides at one arm end, said arm's other end pivotably connected to said frame; and, (b) a connector rod transversly joining said arms, said connector rod extending through said housing outwardly therefrom through arc-shaped slots in said motor housing's sides, said rod being linked through a connector plate to said chain.

8. The leg exerciser according to claim 7 wherein said electrical means to reverse motor direction comprises two directional switchboxes mounted on one housing side proximate each of said arc slot ends, said switchboxes each including a spring loaded switchplate operating an electrical switch, to cause motor stoppage and a change in direction of said chain when engaged, so that as said chain drives said rod through said slot, said rod will contact said switchplate at the arc's end and thereby be electrically reversed to give said periodic leg movement.

9. The leg exerciser according to claim 1 including time adjustment controls to adjust said preferential timing means, said controls located on said housing's exterior and activating time delay switches, said time delay switches located in said motor housing, said time adjustment controls setting the duration of time delay to allow a variety of durations of time delay according to the user's needs.

10. The leg exerciser according to claim 1 including, additionally, a hand operated switch to activate said periodic motion.

11. The leg exerciser according to claim 1 including, additionally, an on/off switch located on said housing's exterior so that a therapist may activate motor of said leg exerciser.

12. The leg exerciser according to claim 1 wherein said frame includes telescoping rods to provide lengthwise adjustibility to said exerciser.

13. The leg exerciser according to claim 1 wherein said duration of said pause is identical when leg is extended and also when the leg is bent.

14. The leg exerciser according to claim 1 wherein said limb support's longitudinal sides are telescoping rods to provide adjustability according to user's leg length.

* * * * *